US006496667B2

(12) United States Patent
Shiratori et al.

(10) Patent No.: US 6,496,667 B2
(45) Date of Patent: Dec. 17, 2002

(54) CARTRIDGE DETACHABLY ATTACHABLE TO IMAGE FORMING APPARATUS

(75) Inventors: Tatsuya Shiratori, Yokohama (JP); Koji Hashimoto, Shizuoka-ken (JP); Kazuhiko Kanno, Odawara (JP); Tachio Kawai, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/820,620

(22) Filed: Mar. 30, 2001

(65) Prior Publication Data

US 2001/0033756 A1 Oct. 25, 2001

(30) Foreign Application Priority Data

Apr. 3, 2000 (JP) ..... 2000-100459

(51) Int. Cl.[7] ..... G03G 15/08

(52) U.S. Cl. ..... 399/103; 399/106; 399/256; 399/263

(58) Field of Search ..... 399/103, 254, 399/255, 258, 263, 262, 260, 106, 256

(56) References Cited

U.S. PATENT DOCUMENTS

| | | | | |
|---|---|---|---|---|
| 5,729,796 | A | 3/1998 | Miura et al. | 399/114 |
| 5,740,500 | A | 4/1998 | Hashimoto | 399/114 |
| 5,768,658 | A | 6/1998 | Watanabe et al. | 399/111 |
| 5,815,644 | A | 9/1998 | Nishiuwatoko et al. | 399/113 |
| 5,870,655 | A | 2/1999 | Nishiuwatoko et al. | 399/111 |
| 5,893,006 | A | 4/1999 | Kanno et al. | 399/13 |
| 5,903,803 | A | 5/1999 | Kawai et al. | 399/116 |
| 5,923,924 | A | 7/1999 | Hashimoto | 399/111 |
| 5,926,666 | A | 7/1999 | Miura et al. | 399/25 |
| 5,937,240 | A | 8/1999 | Kanno et al. | 399/111 |
| 5,940,658 | A | 8/1999 | Yokoi et al. | 399/119 |
| 5,950,049 | A | 9/1999 | Yokomori et al. | 399/119 |
| 6,016,408 | A | 1/2000 | Hashimoto et al. | 399/27 |
| 6,044,235 | A | 3/2000 | Hashimoto | 399/99 |
| 6,055,406 | A | 4/2000 | Kawai et al. | 399/360 |
| 6,070,029 | A | 5/2000 | Nishiuwatoko et al. | 399/111 |
| 6,072,969 | A | 6/2000 | Yokomori et al. | 399/119 |
| 6,101,352 | A | 8/2000 | Hashimoto et al. | 399/119 |
| 6,115,567 | A | 9/2000 | Kawai et al. | 399/106 |
| 6,128,454 | A | 10/2000 | Kawai et al. | 399/116 |
| 6,151,459 | A | 11/2000 | Hashimoto et al. | 399/27 |
| 6,163,665 | A | 12/2000 | Watanabe et al. | 399/111 |
| 6,175,706 | B1 | 1/2001 | Watanabe et al. | 399/167 |
| 6,226,478 | B1 | 5/2001 | Watanabe et al. | 399/117 |

*Primary Examiner*—Susan S. Y. Lee
(74) *Attorney, Agent, or Firm*—Fitzpatrick, Cella, Harper & Scinto

(57) ABSTRACT

A cartridge detachably mountable to a main body of an image forming apparatus, includes a developing frame, a developer carrying member provided in the developer frame and adapted to hold and carry developer, a developer containing container for containing the developer and for supplying the developer to the developer frame, a seal member for unsealably sealing an opening portion through which the developer is supplied from the developer containing container to the developing frame, a rotary member for supplying the developer toward the developer carrying member, a first drive transmitting device for effecting drive transmission between the developer carrying member and the rotary member, and a second drive transmitting device for transmitting the driving to the seal member to unseal the seal member.

27 Claims, 9 Drawing Sheets

CARTRIDGE DETACHABLY ATTACHABLE TO IMAGE FORMING APPARATUS

BACKGROUND OF THE INVENTION

1. Field of the Invention

The present invention relates to a cartridge detachably attachable to a main body of an image forming apparatus.

The image forming apparatus may be, for example, of a type in which an image is formed on a recording medium by using an electrophotographic image forming process, such as an electrophotographic copying machine, an electrophotographic printer (for example, an LED printer, a laser beam printer or the like) and an electrophotographic facsimile apparatus, and, as an example of the cartridge, there is a cartridge integrally incorporating at least developing means and an electrophotographic photosensitive member as an image bearing member into a cartridge unit which can detachably be mounted to the main body of the image forming apparatus. As another example of the cartridge, there is a cartridge which does not have an electrophotographic photosensitive member and has a developing device integrally including a developer containing container storing developer (referred to as "toner" hereinafter) and which can detachably be mounted to the main body of the image forming apparatus.

2. Related Background Art

In conventional image forming apparatuses using an electrophotographic image forming process, a process cartridge system in which an electrophotographic photosensitive member and process means acting on the electrophotographic photosensitive member are integrally incorporated into a cartridge unit which can detachably be mounted to a main body of the image forming apparatus has been used. According to such a process cartridge system, since the maintenance of the apparatus can be performed by the operator himself without any expert, the operability can be enhanced considerably. Thus, such a process cartridge system has widely been used in the image forming apparatuses.

In such a process cartridge, a photosensitive drum is provided and developing means is used for applying developer (toner) to a latent image formed on the photosensitive drum. The developing means is constituted by joining a developing frame holding a developing roller for feeding out the toner to the photosensitive drum to a toner frame (toner container) containing the toner. Before usage, an opening portion defined in a joined portion between the toner frame and the developing frame is sealingly closed by a seal member. There has been proposed a process cartridge having an automatic seal unsealing device in which, upon first usage, when the process, cartridge is mounted to the main body of the image forming apparatus, the seal member sealing the opening portion of the toner frame is automatically unsealed, and an image forming apparatus capable of driving an automatic seal wind-up device of a process cartridge. Similarly, regarding a developing cartridge and a toner cartridge, there has been proposed an automatic seal wind-up device.

The developing apparatus includes various rotary members and a developing process is effected by rotating such rotary members. As an example, there are a toner supplying roller disposed within a toner container and adapted to supply the toner to a developing roller, carrying and agitating means (referred to as merely as "agitating means" hereinafter) for carrying the toner to the developing frame, and a developing roller.

When the process cartridge is inserted into a predetermined position within the main body of the image forming apparatus, a developing roller input gear coaxial with the developing roller is engaged by a driving gear of the main body of the image forming apparatus, with the result that the developing roller is rotated, thereby rotating various rotary members relating to the developing process.

Nowadays, many process cartridges available on the market have mainly been designed so that various rotary members in the developing portion and cleaning portion, and the photosensitive drum are rotated by a process-cartridge driving gear of a driving device of the main body of the apparatus.

There is one (or two at the maximum) interface between the driving apparatus of the main body and a driven portion of the process cartridge. When two interfaces are provided, one of the interfaces relates to input of the photosensitive drum and the other relates to input of developing relating rotary portions. In this arrangement, image quality can be enhanced, and, by separating the input of the photosensitive drum from the input of developing relating rotary portions, uneven rotation of the photosensitive drum due to a change of load in development is prevented. This arrangement is adopted particularly by a high class machine in which a high quality image is requested. If there are three or more driving input portions for the process cartridge, the cost of the process cartridge is increased, and the positioning between the driving input portions of the process cartridge and the driving portion of the main body of the image forming apparatus becomes complicated, and such techniques are not yet used in the present machines available on the market. Normally, the single input of developing relating rotary portions is used.

Further, in recent years, there has also been proposed a process cartridge in which the toner seal is automatically wound up by a winding shaft, and a technique in which various rotary members, such as the winding shaft, the agitating means, the developer supplying roller and the like are rotated simultaneously by a driving force inputted to the developing portion, has also been proposed.

When there are various rotating means, driving mechanisms for rotating the winding shaft and other rotary members are concentrated at one side in a longitudinal direction of the developing roller. As a result, it is considered that the side at which the driving mechanisms are located extremely protrudes with respect to the developing roller, with the result that an installation space for the driving mechanism in the main body of the image forming apparatus is pressed to bring an unbalanced arrangement of the driving mechanisms. Particularly, since the winding shaft must wind up all the seal automatically, it requires sufficient strength, and, a diameter of the shaft is considered to be normally about 10 mm. In such a case, even when the winding shaft is installed in the driving portion of the process cartridge, the longitudinal dimension (perpendicular to a sheet conveying direction) of the process cartridge including the driving apparatus is lengthened. Further, when the other rotary members such as the toner agitating means and the toner supplying roller are also installed in this driving portion, the driving portion of the process cartridge becomes bulky.

Normally, left and right side plates of the main body of the apparatus are adequately spaced apart from each other not to interfere with the insertion of the process cartridge into the main body of the image forming apparatus. In this case, when the process cartridge in which the driving mechanisms are installed only at one side is inserted into the main body of the apparatus, the side plate (of the main body) corresponding to the driving side must be retarded not to interfere with the insertion of the process cartridge. However, on the side plates of the main body, there are installed not only the process cartridge, but also various units, such as the fixing device, a laser scanner, a sheet conveying portion (from the transfer portion to the fixing device), a sheet feeding portion and the like. Other units than the process cartridge are designed not to have a protruded portion at one side, unlike the process cartridge having the seal winding mechanism in the driving portion, and, in such a case, the side plates of the main body must be designed in consideration of the installation position of the process cartridge within the main body of the image forming apparatus and the configuration of the process cartridge passing through the main body of the image forming apparatus.

For these reasons, when the process cartridge has the construction in which the driving portion extremely protrudes in comparison with the other units, the entire distance between the side plates of the main body must be widened in accordance with the dimension of the process cartridge, or a portion of the side plate associated with the process cartridge must be retarded, i.e., the side plate must be partially recessed.

Normally, at the side of the developing apparatus where the driving mechanisms are located, a driving mechanism of the main body of the image forming apparatus (i.e., driving mechanism of the main body of the image forming apparatus for applying the driving force to the developing apparatus and for transmitting a rotational force from a motor to a developing member) is also installed.

In this way, if the driving mechanisms of the developing apparatus are concentrated at one side with respect to the center of the developing roller, not only the side plate of the main body must be reformed, but also the driving apparatus of the main body of the image forming apparatus must be designed in accordance with the reformed side plate. Since the driving mechanism drives not only the process cartridge but also other units such as the fixing device and the sheet feeding device, if drive input positions of these units are differentiated, the driving mechanism of the main body will becomes complicated (to cope with these units) and expensive.

Further, the reformed side plate influences not only the driving mechanism of the main body, but also an outer cover of the main body of the image forming apparatus for enclosing the driving mechanism. If the outer cover is partially protruded to conceal the protruded portion, the entire system will become bulky.

Further, within the process cartridge, if the driving mechanisms are concentrated at one side with respect to the center of the developing roller, various driving paths such as a driving path to the winding shaft, a driving path to the agitating means and a driving path to the toner supplying roller are partially overlapped with each other, which leads to a complicated arrangement in which gears are multi-overlapped. Thus, if a malfunction occurs once, disassembling and repair of the system becomes difficult. Therefore, it is considered that divisional installation of the driving mechanisms is inevitable.

When the toner seal is not yet unsealed by the winding shaft, the toner seal is bonded to the toner container by ultrasonic welding and the toner seal is also secured to the winding shaft. In this way, in the toner-seal unsealed condition, except for the mechanism for driving the winding shaft, other mechanisms disposed at that side cannot be exchanged.

As mentioned above, if the layers of various driving paths (ranges where the driving paths defined by the gears exist) are installed at one side in an overlapped fashion, the following disadvantages occur:

1. Only a portion of the side plate associated with the process cartridge is protruded, thereby affecting an influence of the installation of the driving apparatus of the main body.

2. The configuration of the side plates of the main body must be changed, and the outer cover is also protruded in accordance with the driving apparatus.

3. Since various driving gears are concentrated in the driving portion of the process cartridge, the disassembling becomes difficult, thereby making exchange of parts in the driving portion difficult.

SUMMARY OF THE INVENTION

An object of the present invention is to provide a cartridge in which a toner-seal member can automatically be unsealed.

Another object of the present invention is to provide a cartridge in which drive transmitting portions of the cartridge are prevented from being concentrated at one end in a longitudinal direction of the cartridge.

A further object of the present invention is to provide a cartridge in which an uneven protruded portion is prevented from being created at one end in a longitudinal direction of the cartridge.

A still further object of the present invention is to provide a cartridge in which an outer cover of a main body of an image forming apparatus is prevented from creating an uneven protruded portion and from being made bulky.

A further object of the present invention is to provide a cartridge in which maintenance of a driving system of the cartridge can easily be performed.

The other objects and features of the present invention will be more apparent from the following detailed explanation of the invention referred to the accompanying drawings.

DESCRIPTION OF THE PREFERRED EMBODIMENTS

First Embodiment

Now, a cartridge according to a first embodiment of the present invention, and an image forming apparatus using such a cartridge will be explained.

Figure 1:
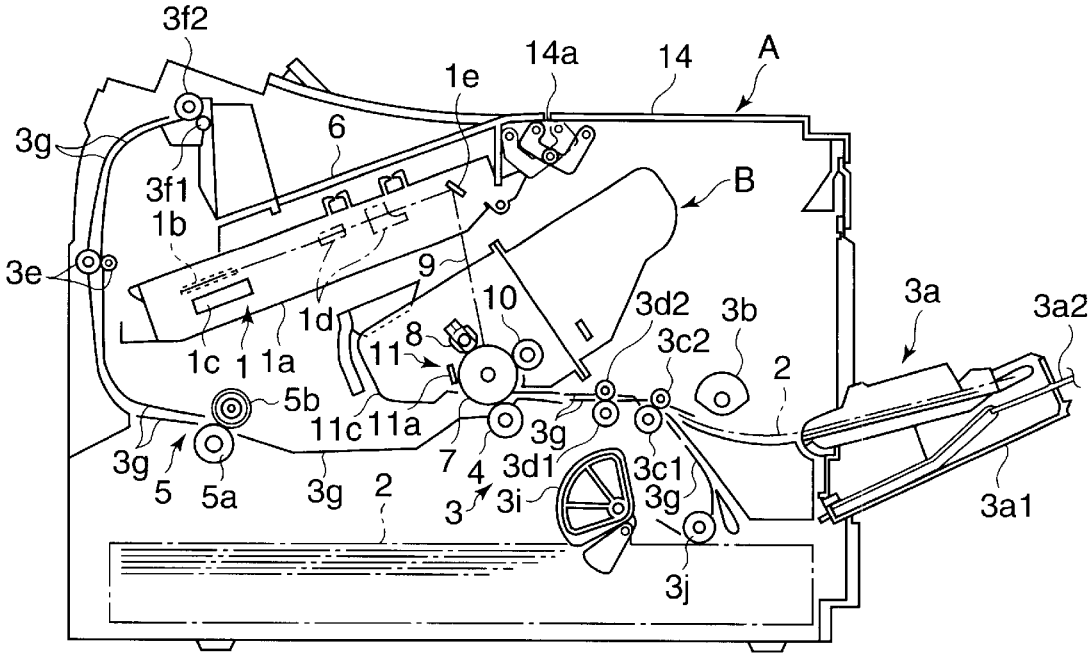
FIG. 1 is a longitudinal sectional view of an image forming apparatus to which a process cartridge according to a first embodiment of the present invention is mounted.
Figure 2:
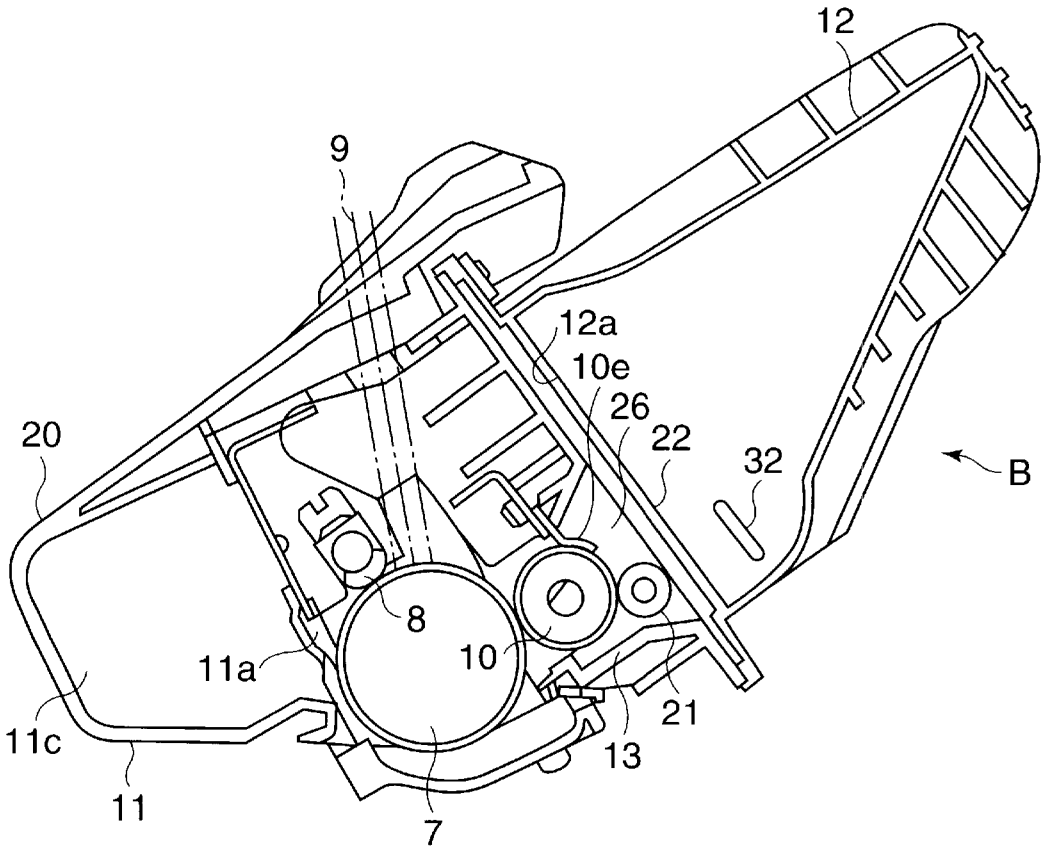
FIG. 2 is a longitudinal sectional view of the process cartridge shown in FIG. 1.

First of all, the entire construction of the image forming apparatus will be briefly described with reference to FIG. 1. FIG. 1 is a sectional view of a laser printer as an example of an image forming apparatus in which a process cartridge B is mounted to a main body 15 of the image forming apparatus, and FIG. 2 is a sectional view of the process cartridge.

As shown in FIG. 1, the main body 15 of the image forming apparatus serves to form a developer image (referred to as "toner image" hereinafter) on a photosensitive drum 7 as an image bearing member by illuminating the photosensitive drum with a light image in response to image information from an optical system 1. In synchronism with the formation of the toner image, a recording material 2 is conveyed by conveying means 3, so that the toner image formed on the photosensitive drum 7 is transferred onto the recording material 2 by transfer means 4 in an image forming portion within the process cartridge B, and, thereafter, the recording material 2 is conveyed to fixing means 5 including a driving roller 5*a* and a fixing roller 5*b*, thereby fixing the transferred toner image onto the recording material. Thereafter, the recording material is discharged onto a discharge portion 6.

(Image Forming Apparatus)

Now, various elements of the image forming apparatus A will be described.

(Electrifying Means)

Electrifying means includes a charging roller 8 of a contact electrifying type, which roller contacts a surface of the photosensitive drum 7 to apply voltage to the photosensitive drum 7, thereby uniformly charging the photosensitive drum 7. Incidentally, the charging roller is press-contacted with the photosensitive drum 7 to be rotatingly driven by the rotation of the drum.

(Optical System)

The optical system 1 serves to illuminate the photosensitive drum 7 with the light image in response to the image information read-in from an external device and the like and comprises an optical unit 1*a* provided in the main body 15 of the apparatus and including a laser diode (not shown), a polygon mirror 1*b*, a scanner motor 1*c*, a focusing lens 1*d* and a reflection mirror 1*e*.

When an image signal is given from the external device, the laser diode emits light is response to the image signal, which light, in turn, illuminates the polygon mirror 1*b* as image light. The polygon mirror 1*b* is rotated at a high speed by the scanner motor 1*c*, and the image light reflected from the polygon mirror 1*b* illuminates the photosensitive drum 7 through the focusing lens 1*d* and the reflection mirror 1*e*, with the result that the surface of the photosensitive drum 7 is selectively exposed, thereby forming the electrostatic latent image on the drum.

(Developing Means)

The developing means serves to feed out toner in a toner container 12 to a developing roller 10 through an opening portion 22 by rotation of an agitating member 32. A peripheral surface of a rotating toner supplying roller 21 slidingly contacts the developing roller 10, and the developing roller 10 to which the toner is adhered is rotated. In this way, a toner layer is formed on the surface of the developing roller 10 while charging the toner tribo-electrically by means of a developing blade 10*e*, and the toner layer is supplied to a developing area on the photosensitive drum 7. When the toner is transferred onto the electrostatic latent image on the photosensitive drum 7, the latent image is visualized as the toner image. The developing blade 10*e* serves to regulate the amount of the toner around the developing roller 10 and to apply the tribo-electricity to the toner.

(Recording Material Conveying Means)

Next, the conveying means 3 for conveying the recording material 2 will be described. In the illustrated embodiment, the recording material 2 can be fed by manual insertion or be fed from a cassette. In the manual insertion, as shown in FIG. 1, when the recording materials 2 are set on a sheet feeding tray 3*a* and the image formation operation is started, the recording materials 2 on the sheet feeding tray 3*a* are fed toward the image forming apparatus by means of a pick- up roller 3*b*, and the fed recording materials are separated, one by one, by means of a pair of separation rollers 3*c*1, 3*c*2, and the separated recording material is conveyed until a leading end of the recording material abuts against a nip between a pair of registration rollers 3*d*1, 3*d*2. In synchronism with the image formation operation, the registration roller pair 3*d*1, 3*d*2 is rotated to convey the recording material 2 to the image forming portion. Further, the recording material 2 on which the image was formed is conveyed to the fixing means 5, and then, the recording material is discharged onto the discharge portion 6 by means of a pair of discharge rollers 3*f*1, 3*f*2. Incidentally, guide members 3*g* are disposed between the above-mentioned roller pairs.

Further, the sheet feeding tray 3*a* comprises an inner member 3*a*1 and an outer member 3*a*2, and, in an unused condition, these members are housed in the main body.

On the other hand, in the cassette feeding, as shown in FIG. 1, the main body 15 of the apparatus has a cassette 3*h* mounting portion at its bottom. When the recording material 2 is not fed by manual insertion, the recording materials 2 contained in the cassette 3*h* mounted to the mounting portion are fed, one by one, to the pair of registration rollers 3*d*1, 3*d*2 by means of a pick-up roller 3*i* and a feeding roller 3*j*. Thereafter, the recording material is conveyed in the same manner as the manual insertion operation.

(Transfer Means)

The transfer means 4 serves to transfer the toner image formed on the photosensitive drum 7 onto the recording material 2 in the image forming portion. In the illustrated embodiment, as shown in FIG. 1, the transfer means 4 includes a transfer roller. That is to say, the recording material 2 is urged against the photosensitive drum 7 of the inserted process cartridge B by the transfer roller, and, by applying voltage having a polarity opposite to that of the toner image formed on the photosensitive drum 7 to the transfer roller, the toner on the photosensitive drum 7 is transferred onto the recording material 2.

(Fixing Means)

The fixing means 5 serves to fix the toner image transferred to the recording material 2 by the voltage applied transfer roller onto the recording material. As shown in FIG. 1, the fixing means comprises the rotating driving roller 5*a*, and the fixing roller 5*b* including therein a heat generating member press contacted with the driving roller 5*a* to be rotatingly driven by the rotation of the driving roller. That is to say, when the recording material 2 to which the toner image was transferred in the image forming portion is being passed through a nip between the driving roller 5*a* and the fixing roller 5*b*, the recording material is subjected to pressure between the rollers 5*a*, 5*b* and heat from the fixing roller 5*b*. As a result, the toner image is fixed to the. recording material 2.

As shown in FIG. 2, in the process cartridge B constituting the image forming portion, the photosensitive drum as the image bearing member is rotated and the surface of the photosensitive drum is uniformly charged by the charging roller as the electrifying means, and the light image from the optical system 1 illuminates the photosensitive drum 7 through an exposure opening portion 9 to thereby form the latent image, and the latent image is visualized by the developing roller as the developing means to form the toner image corresponding to the latent image. After the toner image was transferred to the recording material 2 by the transfer means 4, residual toner remaining on the photosensitive drum 7 is removed by a cleaning blade 11*a* of cleaning means 11, and the removed toner is collected into a removed toner (waste toner) chamber 11*c*.

Incidentally, the process cartridge B is constituted by a toner container (developer containing container) 12 as a first frame having the toner reservoir, a developing frame 13 as a second frame having the developing roller 10 and the like, and a cleaning frame 20 as a third frame having the photosensitive drum 7, cleaning means 11 and the like.

Within the main body 15 of the image forming apparatus, there is provided cartridge mounting means for mounting the process cartridge B. Mounting and dismounting of the process cartridge B with respect to the main body 15 of the apparatus can be performed only after an opening/closing cover 14 is opened around hinges 14*a*.

Figure 3:
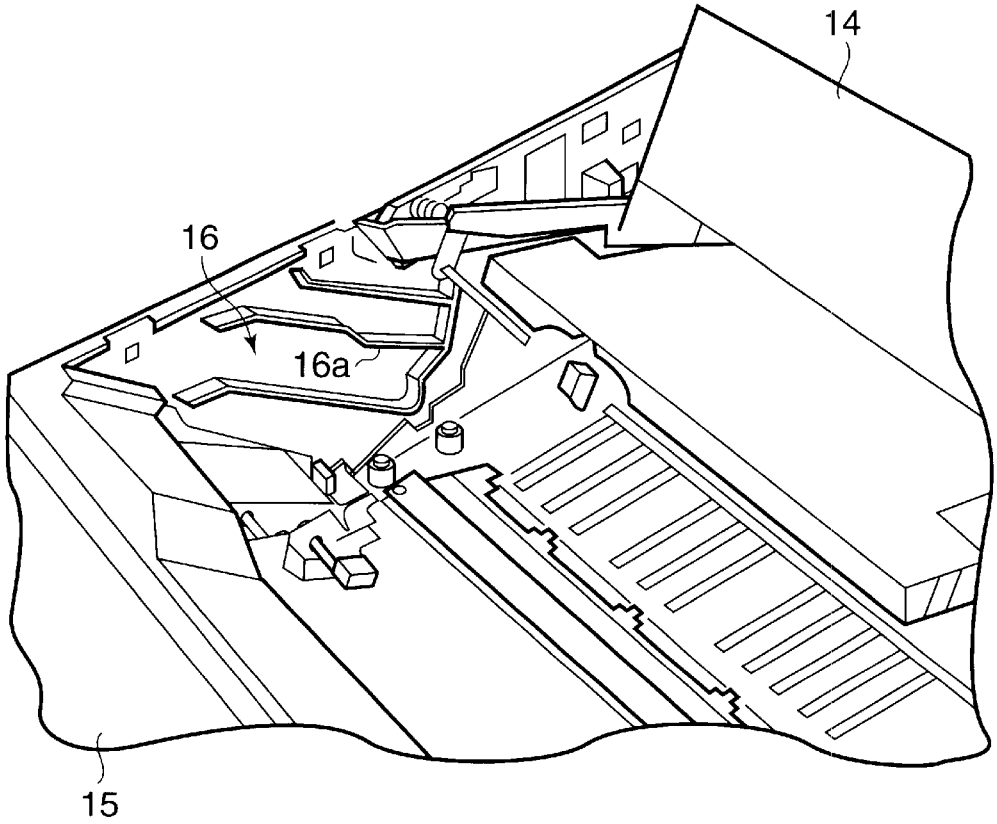
FIG. 3 is a perspective view showing insertion guides of a main body of the image forming apparatus, for guiding the process cartridge.
Figure 4:
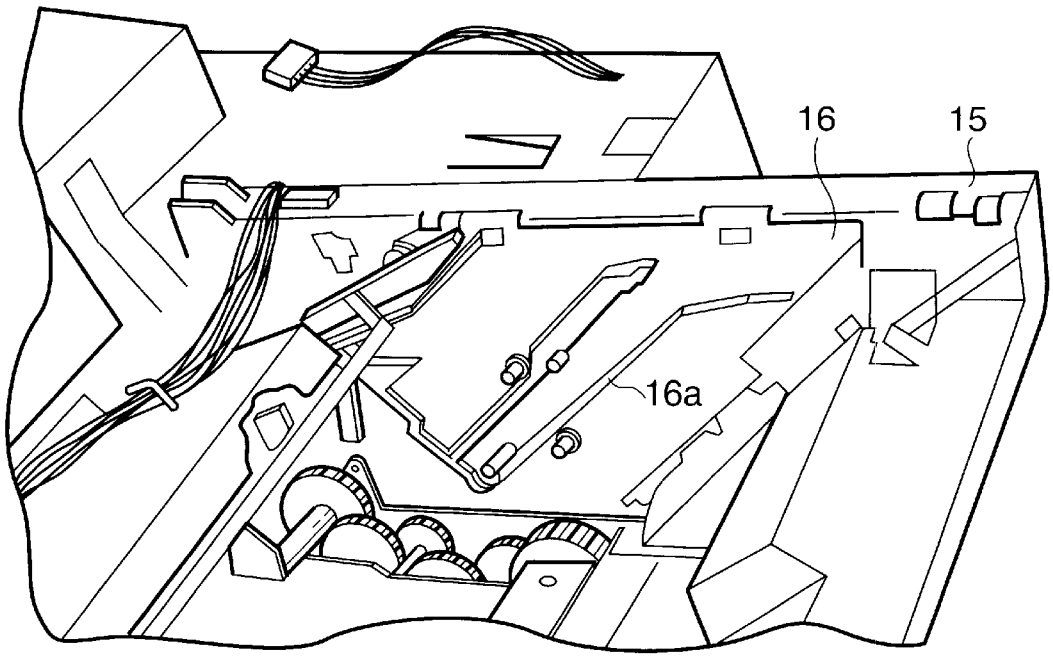
FIG. 4 is a perspective view showing insertion guides of a main body of the image forming apparatus, for guiding the process cartridge.

As shown in FIGS. 3 and 4, cartridge mounting means 16 for mounting the process cartridge B is provided within the main body 15 of the image forming apparatus, and, mounting and dismounting of the process cartridge B with respect to the main body 15 can be performed after the opening/closing cover 14 is opened around the hinges 14*a* (FIG. 1).

When the opening/closing cover 14 is opened, a cartridge mounting space within the main body 15 of the apparatus is exposed, and guide members 16*a* are formed on both side inner walls of the main body 15 of the apparatus. The guide members 16*a* are provided with guide portions into which the process cartridge B is inserted. When the process cartridge B is inserted into a predetermined position along the guide portions and then the opening/closing cover 14 is closed, the mounting of the process cartridge to the main body 15 of the image forming apparatus is completed.

The process cartridge B includes the image bearing member and at least one process means. The process means may be, for example, electrifying means for charging the surface of the image bearing member, developing means for forming a toner image on the image bearing member, and cleaning means for removing residual toner remaining on the surface of the image bearing member. Incidentally, in the present invention, the process cartridge includes at least the developing means.

In the process cartridge B according to the illustrated embodiment, as shown in FIG. 2, the charging g roller 8 as the electrifying means, the exposure opening portion 9, the developing roller 10 as the developing means, the cleaning means 11, and the toner supplying roller 21 for supplying toner to the developing roller 10 are disposed around electrophotographic photosensitive drum 7 as the image bearing member, and these elements are covered by a housing comprised of the toner container 12, the developing frame 13 and the cleaning frame 20 to thereby form a cartridge unit which can detachably be mounted to the main body 15 of the apparatus.

(Seal Member Unsealing Mechanism)

Next, a seal member unsealing mechanism for the process cartridge B will be described with reference to FIGS. 5 and 6.

In the process cartridge B, a toner supplying opening portion 22 is formed in a partition wall 12*a* between the toner container 12 containing the toner and a developing chamber 26 (FIG. 2), and the opening portion 22 is thermally sealed by a seal member 23 by means of hot melt, thereby sealing the toner within the toner container 12.

Figure 5:
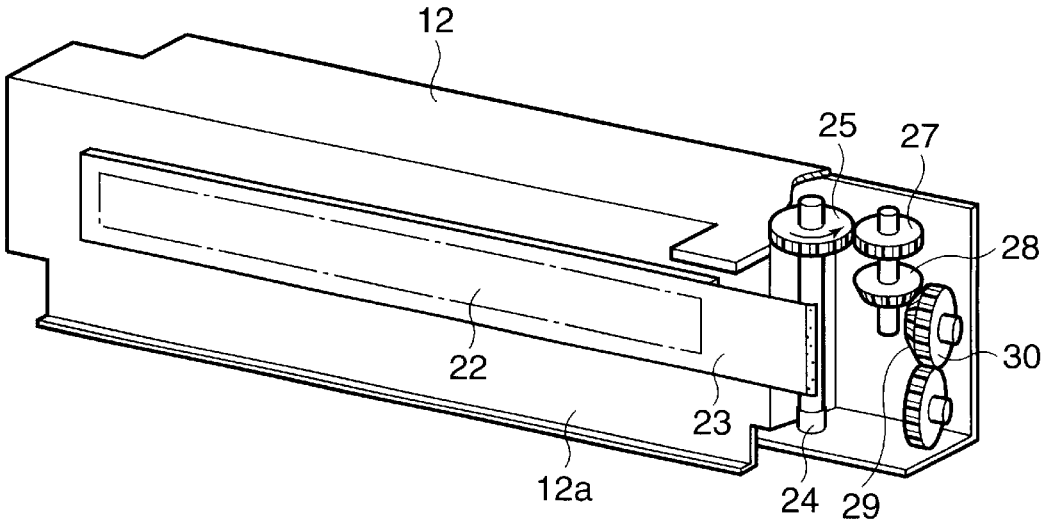
FIG. 5 is a perspective view of a seal-member unsealing device of the process cartridge of FIG. 2, showing an unsealed condition.

In FIG. 5, the seal member 23 extends to the right side of the opening portion 22 to the left to close the opening portion 22 and then is folded back to extend to the right, and a distal end of the seal member is secured to a winding shaft 24. FIG. 5 shows a gear arrangement in a winding shaft portion.

The seal member 23 is welded to the winding shaft 24. A winding gear 25 is secured to the winding shaft 24 above the seal member 23. The gear 25 meshed with an idler gear 27 below which there are provided a bevel gear 28 and a bevel gear 29 meshed with the gear 28, thereby changing the drive rotational direction. A gear 30 secured coaxial with the bevel gear 29 and rotated together with this bevel gear is meshed with a gear (not shown) on the developing roller so that the rotation of the developing roller 10 is transmitted to the winding shaft 24. Further, the rotational speed of the gear on the developing roller is reduced by the intermediate gear train, thereby creating a rotational torque and a rotational speed required for the winding shaft 24. Incidentally, the winding shaft 24, a shaft for the gears 27, 28 and a shaft for the gears 29, 30 are rotatably supported by the developing frame 13.

Figure 6:
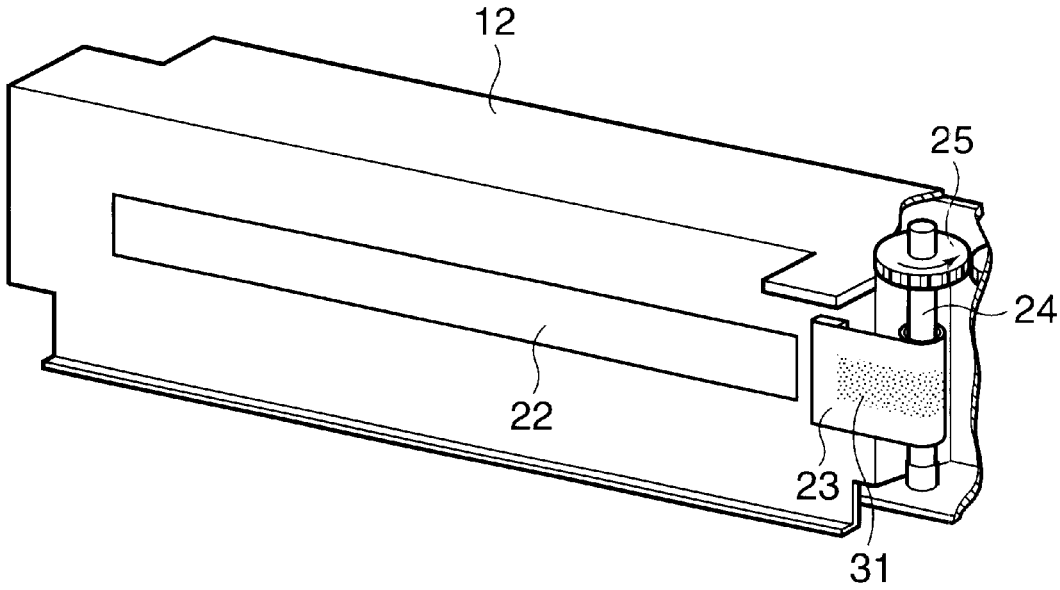
FIG. 6 is a perspective view showing a sealed condition of the process cartridge of FIG. 5.

FIG. 6 shows the condition that the toner seal (seal member) is wound up by the winding shaft under the action of the winding mechanism. As shown, although the toner 31 is adhered to the seal member 23, since the seal member 23 is wound up by the winding shaft 24, such toner is not scattered out of the process cartridge B in comparison with a case where the seal member 23 is peeled by the operator himself, thereby achieving clean working. In addition, since the seal member 23 is contained within the process cartridge, only the seal member is not discarded. Thus, by returning the used process cartridge to the cartridge maker, the operator's burden for treating the seal member as scrap can be avoided. As shown in a graph of FIG. 7 in which the abscissa indicates elapsed time t from pull-out start and the ordinate indicates pull-out forces D, E, F, a force required for unsealing the seal member 23 reaches a first peak of D kg at the pull-out start and then is stabilized to E kg and lastly reaches a second peak of D2 kg. Thereafter, the seal member 23 is completely wound around the winding shaft 24 to reduce the pull-out force to F kg. The force F corresponds to a force for merely rotating the winding shaft 24 idly.

In this way, the pull-out force at the end of the seal member 23 is higher than that at a central portion thereof. The winding shaft 24 must have strength capable of resisting such peak pull-out forces.

Incidentally, FIGS. 5 and 6 show only one example of the seal-member unsealing mechanism and differs from the following embodiment.

Figure 8:
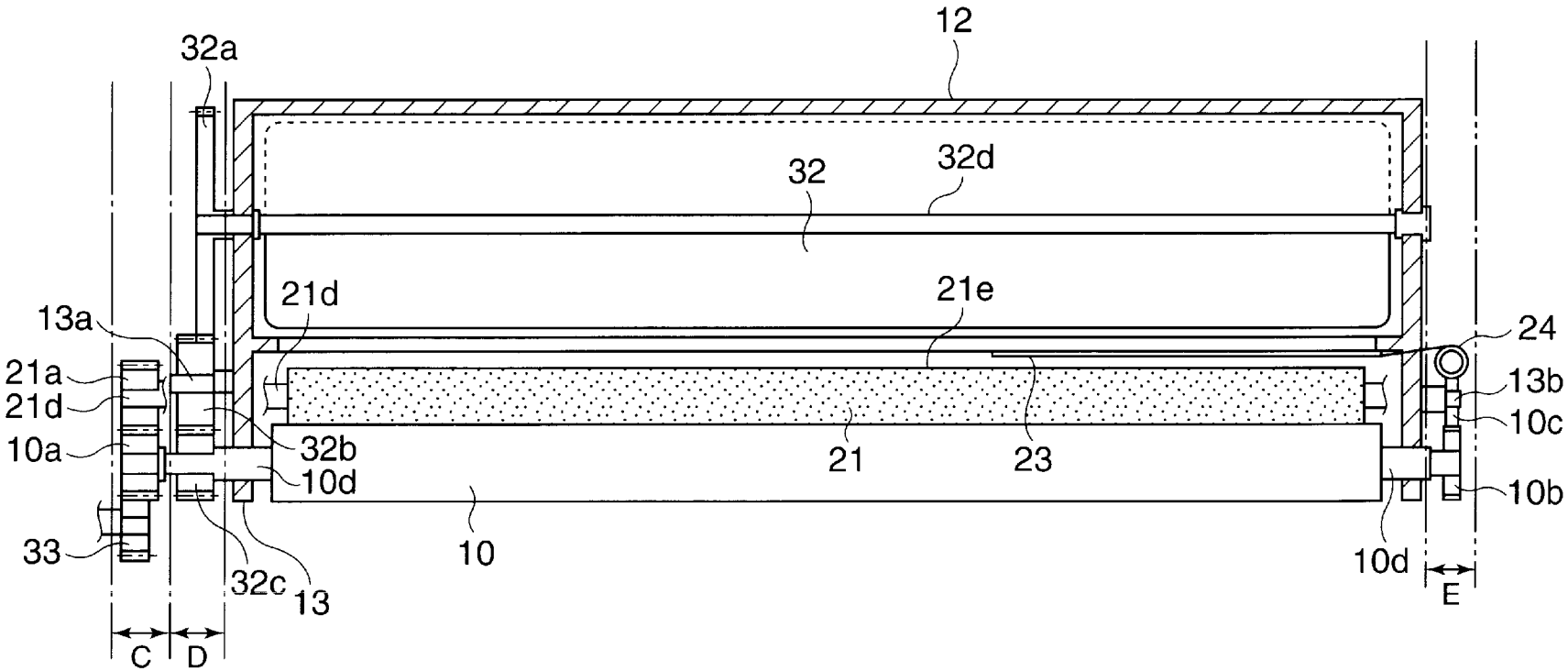
FIG. 8 is a sectional view of a developing apparatus according to a concrete first embodiment of the present invention.

FIG. 8 is a sectional view of a developing apparatus portion of a process cartridge associated with the present invention.

As shown, in this developing apparatus, there are provided an agitating member 32 for agitating toner, a toner supplying roller 21 for supplying the toner to a developing roller 10, and a winding shaft 21 for automatically winding up a seal member 23, and these elements are driven by rotation of the developing roller 10. Further, the developing roller 10 is driven by a main body 15 of the image forming apparatus.

The agitating member 32 has a central rotary shaft 32*d*. The central rotary shaft 32*d* is rotatably supported by a toner container 12. A gear 32*a* is secured to an end portion of the central rotary shaft 32*d* protruded outwardly from the toner container 12. The gear 32*a* is meshed with an idler gear 32*b*, which is in turn meshed with an input gear 32*c* integrally rotated together with the developing roller 10. The idler gear 32*b* is rotatably supported on a fixed shaft 13*a* provided on a developing frame 13. The developing roller 10 has a central shaft 10*d* rotatably supported by the developing frame 13.

The main body 15 of the image forming apparatus is provided with a body side driving gear 33, rotatably supported by the main body 15 of the apparatus and adapted to receive a driving force from a motor (not shown) of the main body 15 of the image forming apparatus and to transmit such driving force, to the input gear 32*c*. The gear 33 is meshed with a developing roller input gear 10*a* secured to the developing roller shaft 10*d* so that the driving force is transmitted to a toner supplying roller gear 21*a* via the gear 10*a*. The toner supplying roller gear 21*a* is secured to a toner supplying roller shaft 21*d*. An elastic roller 21*e* and the gear 21*a* are secured to the toner supplying roller shaft 21*d*. The toner supplying roller shaft 21*d* is rotatably supported by the developing frame 13. By rotating the toner supplying roller 21 by the rotation of the developing roller 10, the toner in the developing chamber 26 is coated on the developing roller 10.

At the other end of the developing roller 10, a winding input gear (winding shaft drive connecting gear) 10*b* for transmitting a driving force to the winding shaft 24 is secured to the developing roller shaft 10*d*. A rotation of the winding input gear 10*b* is transmitted to a spiral gear (not shown) integrally secured to the winding shaft 24 through a spiral gear 10*c*, so that the winding shaft 24 is rotated by the rotation of the developing roller 10, thereby unsealing the toner seal 23. Incidentally, the spiral gear 10*c* is rotatably mounted on a fixed shaft 13*b* provided on the developing frame 13 and supported not to shift in an axial direction. The drive transmitting mechanism from the developing roller 10 to the winding shaft 24 is not particularly limited but may be designed as shown in FIG. 5, for example.

As shown in FIG. 8, in the present invention, the driving of the developing portion is divided into three layers C, D and E.

The C layer is a toner supplying roller driving portion including (the main body driving gear 33), the developing roller input gear 10*a* and gear 21*a*, the D layer is an agitating member driving portion including the gear 32*a*, the idler gear 32*b* and the drive input gear 32*c*, and the E layer is a winding shaft driving portion including the winding input gear (winding shaft drive connecting gear) 10*b* and the spiral gear 10*c*.

The present invention provides a driving arrangement when the E layer is mainly considered, and the C, D and E layers are not concentrated at one side in the longitudinal direction of the developing roller 10, and at least one driving layer is disposed at a side opposite to the E layer.

Incidentally, in the arrangement according to the illustrated embodiment, while an example that the driving force is inputted to the C layer from the main body driving gear 33 to rotate the developing roller 10 was shown, the main body driving gear 33 may be provided in the D layer or the E layer. Further, the D layer as a toner supplying roller driving layer may be included in the E layer.

Second Embodiment

Figure 9:
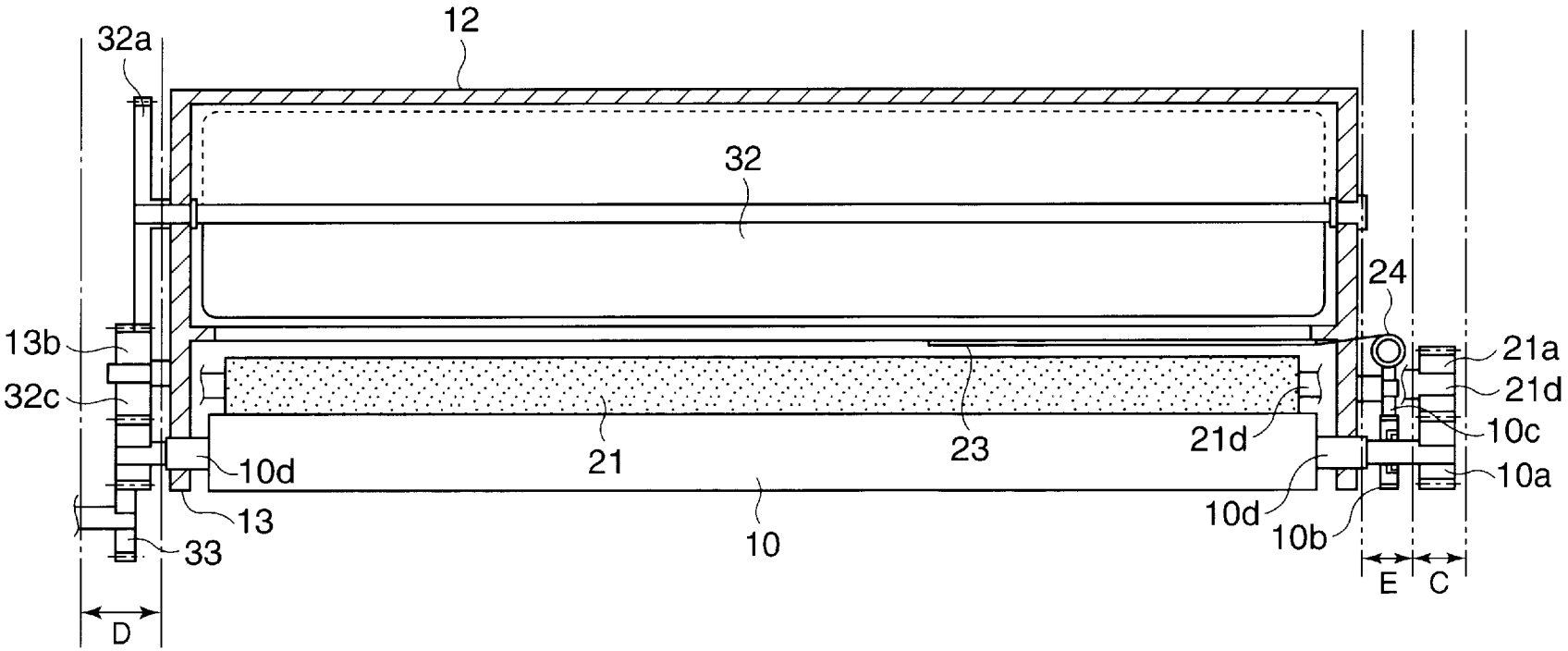
FIG. 9 is a sectional view of a developing apparatus according to a concrete second embodiment of the present invention.

Alternatively, in the present invention, the C layer may also be located at the same side as the E layer. In this case, as shown in FIG. 9, the C layer is always positioned outwardly of the E layer with respect to the center of the longitudinal direction of the developing roller 10.

With this arrangement (in which the C layer is positioned outwardly of the E layer), if a consumed part such as the toner supplying roller 21 is exchanged or if the toner supplying roller is exchanged after assembling for any reason, the exchanging operation is facilitated. Particularly, the toner seal 23 is firmly secured to the winding shaft 24 not to easily be separated therefrom, and, thus, the winding shaft 24 cannot easily be removed. Further, the toner seal 23 is welded to the toner container 12 by the ultrasonic welding. Accordingly, it is impossible to disassemble the mechanical parts in the winding shaft driving portion (E layer) and to remove the part in any inner layer. For this reason, the winding shaft driving portion (E layer) must be positioned nearest to the center of the developing apparatus. Also in this arrangement, the C, D and E layers are not concentrated at one side of the developing roller.

Third Embodiment

In the above-mentioned first and second embodiment, while an example that the driving gear of the main body 15 of the apparatus is meshed with the gear on the developing roller to distribute the rotational force to various driving systems was explained, the present invention is not limited to such an example. Any arrangement can be adopted so long as the developing roller 10 constitutes the drive transmitting means and plural driving systems are disposed on both ends of the developing roller 10. For example, an arrangement, in which the gears 21*a* coaxial with the idler gear 32*b* and the toner supplying roller 21 are operatively connected to the drive gear of the main body 15 of the apparatus via appropriate means (not shown) to transmit the driving force from the main body 15 of the apparatus to the developing roller 10 to thereby rotate the other driving systems, may be used.

In the above-mentioned first embodiment, while an example that, when the seal member 23 is peeled, the entire seal member 23 (including the portion thermally welded around the toner supplying opening portion 22) except for one end of the seal member 23 is unsealed was explained, in the present invention, the seal member securing method is not particularly limited, and, for example, a seal member may be constituted by a flexible first film (referred to "seal film" hereinafter) for covering the opening portion 22 defined between the toner container 12 and the developing frame 13 and is capable of being torn along the peeling direction, and a stripe-shaped second film (tear tape) for tearing the seal film in a longitudinal direction to create a toner supplying opening.

The seal film may be formed from composite film comprised of polyester/aluminum or polypropylene having uniaxial ductility.

Further, while an example that the peel-start portion of the seal member is welded along the same width as the entire width of the seal member was shown, a system (easy peeling system) in which the welding area of the seal member at the peel start portion is inclined with respect to the peeling direction to permit the peeling force to be concentrated at a distal end of the inclined area so that the peeling can easily be effected may be used.

Incidentally, regarding the process cartridge, while an example that the photosensitive drum, the electrifying means, the developing means and the cleaning means are integrally incorporated into the cartridge unit was explained, at least the developing means (as process means) and the electrophotographic photosensitive member may be integrally incorporated into a cartridge unit that can be detachably mounted to the main body of the image forming apparatus (for example, a copying machine, an LBP or the like).

In the illustrated embodiments, while the process cartridge was explained, the present invention can be applied to a developing cartridge 2 in which a developing member and developer are integrally contained in a unit which can detachably be mounted to the main body of the image forming apparatus. In the developing cartridge, the developing frame and the developer containing container are welded together.

As mentioned above, the above-mentioned example proposes a divisional arrangement in which one or both of the driving apparatuses (gear trains) for the rotating means (for example, agitating means) and the developer supplying roller are located at a side of the developing roller (in the longitudinal direction thereof) opposite to the side where the driving apparatus for the winding shaft is disposed. With this arrangement, unlike conventional techniques, disadvantages (giving a bad feeling to the user), such as only the side where all of the driving apparatuses are located is protruded and the outer cover for the main body is also protruded unevenly in comparison with the other side or the outer cover is made bulky to conceal the protruded portion, can be eliminated.

Similarly, the arrangement of the associated driving mechanisms of the main body of the image forming apparatus is not made complicated. Further, at the side where the winding shaft is located, by positioning the driving apparatus (developer supplying roller input gear and the associated idler gear) for the developer supplying roller outwardly of the driving apparatus for the winding shaft, if the developer supplying roller must be exchanged due to manufacturing trouble, such exchange can easily be performed.

When the driving apparatuses for other rotary members are positioned at the side opposite to the side where the winding shaft driving apparatus or when the driving apparatus for the rotary member disposed at the same side as the winding shaft is positioned outwardly of the winding shaft driving apparatus, good balance of the developing apparatus and the main body of the image forming apparatus can be achieved, and the construction of the mechanism portions can be simplified, and easy disassembling ability upon malfunction can be obtained.

What is claimed is:

1. A cartridge detachably mountable to a main body of an image forming apparatus, comprising:

a developing frame;

a developer carrying member provided in said developer frame and adapted to hold and carry developer;

a developer containing container for containing the developer and for supplying the developer to said developer frame;

a seal member for unsealably sealing an opening portion through which the developer is supplied from said developer containing container to said developing frame;

a rotary member for supplying the developer toward said developer carrying member;

first drive transmitting means for effecting drive transmission between said developer carrying member and said rotary member; and second drive transmitting means for transmitting the driving to said seal member to unseal said seal member;

and wherein at least a part of said first drive transmitting means is provided at one end side of said developer carrying member in a longitudinal direction thereof and said second drive transmitting means is provided at the other end side of said developer carrying member in the longitudinal direction, and drive transmission between said one end side and said the other end side is effected by said developer carrying member or said rotary member.

2. A cartridge according to claim 1, wherein said first drive transmitting means performs the drive transmission from said developer carrying member to said rotary member.

3. A cartridge according to claim 1, wherein said second drive transmitting means includes a winding member for winding up said seal member.

4. A cartridge according to claim 1, wherein said rotary member has an agitating member for agitating the developer and said agitating member is provided within said developer containing container.

5. A cartridge according to claim 1, wherein said rotary member comprises a roller contacting said developer carrying member.

6. A cartridge according to claim 1, further comprising a second rotary member for supplying the developer toward said developer carrying member, and third drive transmitting means for effecting drive transmission between said second rotary member and said developer carrying member, and wherein said third drive transmitting means is provided at said one end side.

7. A cartridge according to claim 6, wherein said rotary member comprises a roller contacting said developer carrying member, and said second rotary member comprises an agitating member provided in said developer containing container and adapted to agitate the developer.

8. A cartridge according to claim 1, wherein said first drive transmitting means includes, a first gear provided on said developer carrying member and a second gear provided on said rotary member, and said first and second gears are provided at said one end side.

9. A cartridge according to claim 3, wherein said second drive transmitting means includes a first gear provided on said developer carrying member or said rotary member and a second gear provided on said winding member, and said first and second gears are provided at said the other end side.

10. A cartridge according to claim 3, wherein said first drive transmitting means includes a first gear provided on said developer carrying member and a second gear provided on said rotary member, and said first and second gears are provided at said one end side, and said second drive transmitting means includes a third gear provided on said developer carrying member or said rotary member and a fourth gear provided on said winding member, and said third and fourth gears are provided at said the other end side.

11. A cartridge according to claim 6, wherein said third drive transmitting means includes a first gear provided on said developer carrying member and a second gear provided on said second rotary member, and said first and second gears are provided at said one end side.

12. A cartridge according to claim 1, wherein the driving is transmitted from said main body of said image forming apparatus to said one end side.

13. A cartridge according to claim 1, wherein said developer carrying member has an input gear to which the driving is inputted from said main body of said image forming apparatus.

14. A cartridge according to claim 1, further comprising a second rotary member for supplying the developer toward said developer carrying member, and third drive transmitting means for effecting drive transmission between said second rotary member and said developer carrying member, and wherein said third drive transmitting means is provided at said the other end, and said second drive transmitting means is positioned outwardly of said third drive transmitting means in the longitudinal direction of said developer carrying member.

15. A cartridge according to claim 1, wherein said developer carrying member is a roller.

16. A cartridge according to claim 1, further comprising an image bearing member to which the developer is supplied by said developer carrying member.

17. A cartridge detachably mountable to a main body of an image forming apparatus, comprising:

a developing frame;

a developer carrying member provided in said developer frame and adapted to hold and carry developer;

a developer containing container for containing the developer and for supplying the developer to said developer frame;

a seal member for unsealably sealing an opening portion through which the developer is supplied from said developer containing container to said developing frame;

a rotary member for supplying the developer toward said developer carrying member; and drive transmitting means for transmitting the driving to said seal member to unseal said seal member;

and wherein the driving is inputted from said main body of said image forming apparatus to one end side of said developer carrying member in a longitudinal direction thereof and said drive transmitting means is provided at the other end side of said developer carrying member in the longitudinal direction, and drive transmission between said one end side and said the other end side is effected by said developer carrying member or said rotary member.

18. A cartridge according to claim 17, wherein said drive transmitting means includes a winding member for winding up said seal member.

19. A cartridge according to claim 17, wherein said rotary member has an agitating member for agitating the developer and said agitating member is provided within said developer containing container.

20. A cartridge according to claim 17, wherein said rotary member comprises a roller contacting said developer carrying member.

21. A cartridge according to claim 17, further comprising a second rotary member for supplying the developer toward said developer carrying member, and second drive transmitting means for effecting drive transmission between said second rotary member and said developer carrying member, and wherein said second drive transmitting means is provided at said one end side.

22. A cartridge according to claim 21, wherein said rotary member comprises a roller contacted with said developer carrying member, and said second rotary member comprises an agitating member provided in said developer containing container and adapted to agitate the developer.

23. A cartridge according to claim 21, wherein said second drive transmitting means includes a first gear provided on said developer carrying member and a second gear provided on said rotary member, and said first and second gears are provided at said one end side.

24. A cartridge according to claim 17, wherein said drive transmitting means includes a first gear provided on said developer carrying member or said rotary member and a second gear provided on a winding member, and said first and second gears are provided at said the other end side.

25. A cartridge according to claim 17, wherein said developer carrying member has an input gear to which the driving is inputted from said main body of said image forming apparatus.

26. A cartridge according to claim 17, wherein said developer carrying member is a roller.

27. A cartridge according to claim 17, further comprising an image bearing member to which the developer is supplied by said developer carrying member.

* * * * *

UNITED STATES PATENT AND TRADEMARK OFFICE

CERTIFICATE OF CORRECTION

PATENT NO. : 6,496,667 B2
DATED : December 17, 2002
INVENTOR(S) : Tatsuya Shiratori et al.

Figure 7:
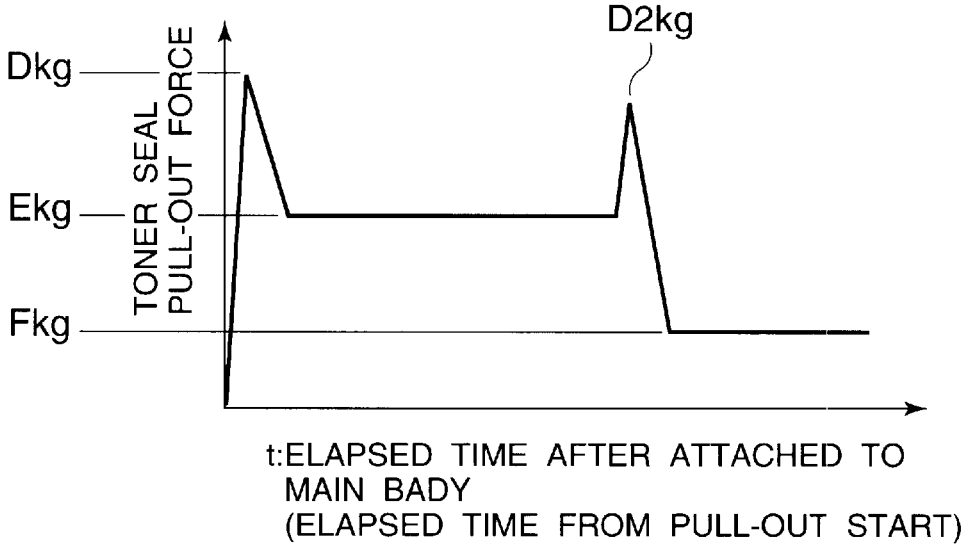
FIG. 7 is a graph for explaining the transition of a toner-seal peeling force (pull-out force)

It is certified that error appears in the above-identified patent and that said Letters Patent is hereby corrected as shown below:

Drawings,
Sheet No. 7, Figure 7, "BADY" should read -- BODY --.

Column 3,
Line 41, "becomes" should read -- become --.

Column 6,
Line 60, "the." should read -- the --.

Signed and Sealed this

Eighteenth Day of November, 2003

JAMES E. ROGAN
*Director of the United States Patent and Trademark Office*